US006257086B1

(12) United States Patent
Petersen

(10) Patent No.: US 6,257,086 B1
(45) Date of Patent: Jul. 10, 2001

(54) TOY GEAR BOX AND A GEAR CASE THEREFOR

(75) Inventor: Pelle Normann Petersen, Jelling (DK)

(73) Assignee: INTERLEGO AG, Baar (CH)

( * ) Notice: Subject to any disclaimer, the term of this patent is extended or adjusted under 35 U.S.C. 154(b) by 0 days.

(21) Appl. No.: 09/416,689

(22) Filed: Oct. 12, 1999

(30) Foreign Application Priority Data

Oct. 14, 1998 (DK) ..... 1998 01309

(51) Int. Cl.[7] ..... F16H 1/16
(52) U.S. Cl. ..... 74/425; 74/425.5; 74/435
(58) Field of Search ..... 74/425, 425.5, 74/435, 393, 606 R

(56) References Cited

U.S. PATENT DOCUMENTS 5,346,420 9/1994 Glickman .

FOREIGN PATENT DOCUMENTS

| | | | |
|---|---|---|---|
| 1 197 365 | | 7/1965 | (DE) . |
| 857889-A1 | * | 8/1998 | (EP) . |
| 1 292 262 | | 10/1972 | (GB) . |
| 2000126475 | * | 5/2000 | (JP) . |
| 116 709 | | 5/1969 | (NO) . |
| 338 938 | | 9/1968 | (SE) . |

* cited by examiner

*Primary Examiner*—Dirk Wright
(74) *Attorney, Agent, or Firm*—Pitney, Hardin, Kipp & Szuch LLP

(57) ABSTRACT

A toy gear box having a gear case in which a worm wheel and a gear wheel having axes of rotation transversely to each other are in operative engagement with each other with a specific gear ratio. The gear wheel is replaceable, and at least one second gear wheel having a second number of teeth different from the first number may be inserted into the gear box, thereby imparting a second gear ratio to the gear box. The gear case (10) has a toothed rim in firm connection with the gear case (10), and the gear case (10) can receive such a toothed rim on another such gear case as a gear wheel.

13 Claims, 3 Drawing Sheets

TOY GEAR BOX AND A GEAR CASE THEREFOR

The invention relates to a toy gear box having a gear case in which a worm wheel and a gear wheel with axes of rotation transversely to each other are in operative engagement with each other with a specific gear ratio. Such gear boxes usually have a specific gear ratio which is considerably smaller than 1. The invention also relates to a gear case for such a toy gear box.

DE 1 197 365 shows a toy gear box having a worm wheel which drives a first gear wheel. The shaft of the first gear wheel may be moved transversely, and thereby the first gear wheel may alternatively get into engagement with two other gear wheels having their respective numbers of teeth. The gear box hereby has two different gear ratios.

U.S. Pat. No. 4,878,877 shows a toy car having a motor whose output shaft carries a worm wheel in permanent operative engagement with two uniform gear wheels on their respective sides of the worm wheel, whereby these two gear wheels are driven in opposite directions. This arrangement may be tilted so that one or the other of the gear wheels is engaged with a third gear wheel and drives this in one or the other direction.

The invention provides a toy gear box which the user himself can assemble, and various gear ratios may be obtained by means of replaceable gear wheels. The gear case of the toy gear box may be provided with a toothed rim in firm connection with the gear case, and the gear case is then adapted to receive such a toothed rim on a second gear box in the same manner as a replaceable gear wheel. Hereby, not only the toothed rim of the second gear case, but the entire second gear box is rotated when the worm wheel of the first gear box rotates. Imaginative constructions may be built with two or more such gear boxes.

Figure 1:
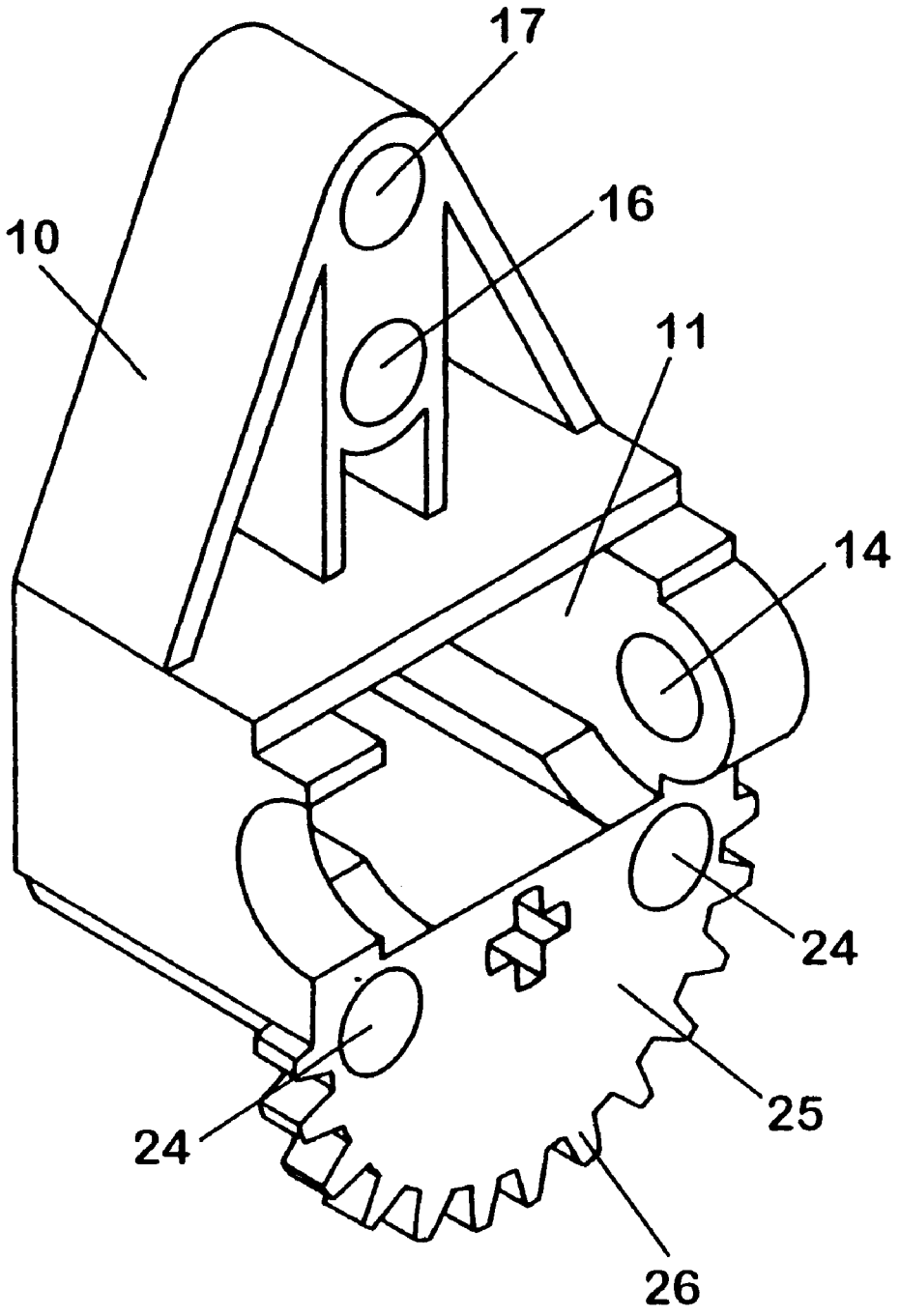
Figure 2:
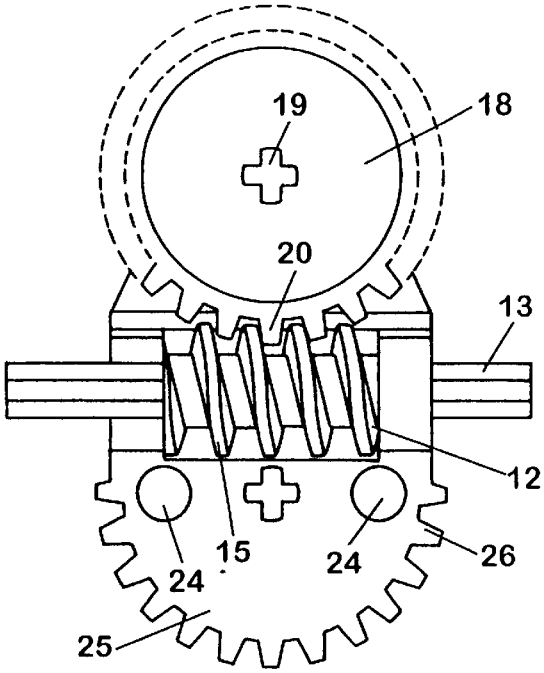
Figure 3:
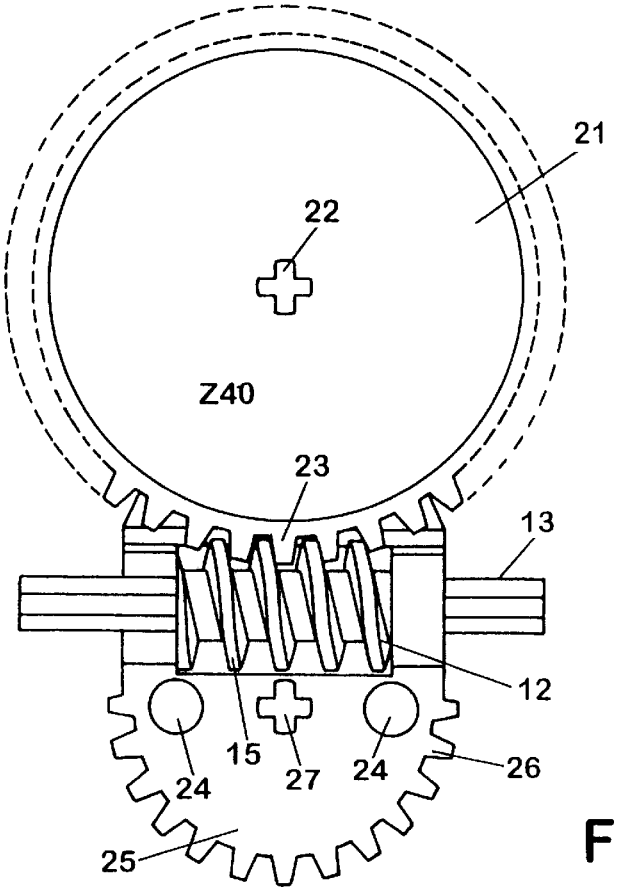
Figure 4:
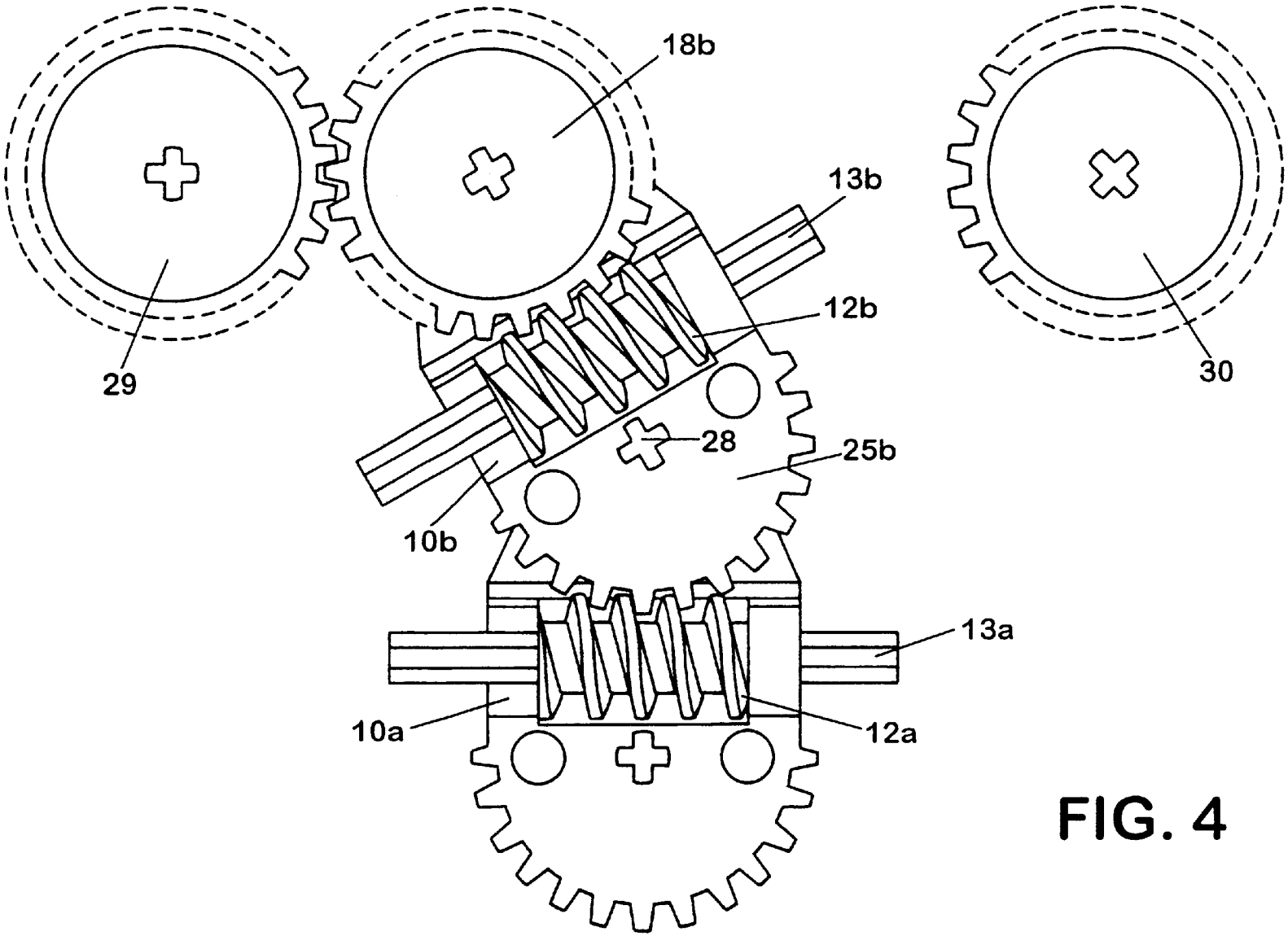

The invention will be described below with a preferred embodiment as an example and with reference to the drawings, in which FIG. 1 shows one half of a gear case for a toy gear box according to invention, FIG. 2 shows half the gear case of FIG. 1 with a worm wheel and a first gear wheel, FIG. 3 shows half the gear case of FIG. 1 with a worm wheel and a second gear wheel, and FIG. 4 shows two gear boxes according to the invention built together.

FIGS. 1–3 show one half 10 for the construction of a gear case for a toy gear box. For clarity, only one half of the gear case is shown, thereby making the interior of the gear box visible. Two such halves 10 are used for the construction of a gear box. The gear box half 10 has a cavity 11 for receiving a worm wheel 12, as shown in FIGS. 2–3, where the worm wheel is mounted on a shaft 13 of cross-shaped cross-section. The shaft 13 of the worm wheel is received in an opening 14 which serves as a bearing for the shaft 13. The worm wheel 12 has a single thread 15, but might just as well have a double or multiple thread.

It will be seen in FIG. 1 that the gear case half 10 has two openings 16 and 17, each of which can receive a shaft of the same type as the shaft 13. In FIG. 2, a first gear wheel 18 having a shaft 19 is mounted in half the gear case 10 with the shaft 19 in the opening 16 which serves as a bearing for the shaft 19. The gear wheel 18 has teeth 20 which are in engagement with the thread 15 of the worm wheel. FIG. 3 similarly shows a second gear wheel 21 having a shaft 22 mounted in half the gear case 10 with the shaft 22 in the opening 17 which serves as a bearing for the shaft 22. The gear wheel 21 has teeth 23 which are likewise in engagement with the thread 15 of the worm wheel. In the example shown, the first gear wheel 18 has 24 teeth 20, and the second gear wheel 21 has 40 teeth 23.

When the gear box is to be assembled, two gear case halves 10 are used, having two symmetrically arranged holes 24 for receiving assembling means in the form of studs or the like for securing the assembled halves by snap effect. First, two assembling means are arranged in the openings 24, and then one of the gear wheels 18, 21 with associated shaft 19, 22 in the one half gear case 10, as shown in FIGS. 2 and 3, respectively. Then, the worm wheel 12 without its shaft 13 is placed in the cavity 11, and the second gear case half is arranged reversed thereon and is assembled with the first half by the assembling means, and finally the shaft 13 of the worm wheel is passed through the openings 14 in their respective half cases 10 and through a through-going channel in the worm wheel 12.

When the shaft 13 of the worm wheel is rotated one revolution, the gear wheels 18 and 21 will rotate as much as corresponds to one tooth on their periphery. This means that in FIG. 2, in which the first gear wheel has 24 teeth, the worm wheel must rotate 24 revolutions in order to rotate the first gear wheel one revolution, which corresponds to a gear ratio of 24:1. In FIG. 3, where the second gear wheel has 40 teeth, the worm wheel must rotate 40 revolutions in order to rotate the second gear wheel one revolution, which corresponds to a gear ratio of 40:1.

If a user wants another gear ratio, he/she can easily disassemble the assembled gear box and insert another gear wheel. The gear box is incorporated as a new component in an existing toy building set having numerous building possibilities and may be built together with this. The gear wheels 18 and 21 are thus merely two of a series of gear wheels having different numbers of teeth.

It will be seen in FIGS. 1–3 that half the gear housing 10 has a semicircular disc 25 with teeth 26 which forms a toothed rim with teeth 26. The toothed rim 25 has the same diameter as the first gear wheel 18, and a cross-shaped opening 27 is provided between the two openings 24 in the centre of the toothed rim, said opening serving to receive a cross-shaped shaft like the shaft 13.

FIG. 4 shows two half gear cases 10*a* and 10*b*, where the gear case 10*b* is provided with a shaft 28 of cross-shaped cross-section through the opening 27 and further into the opening 16 (not shown) in the gear case 10*a*, so that the opening 16 serves as a bearing for the shaft 28. Rotation of the shaft 13*a* by means of the worm wheel 12*a* in the gear case 10*a* will cause the toothed rim 25*b* to rotate in the same manner as in the structure of FIGS. 2–3, and will thereby also cause the gear case 10*b* to rotate about its shaft 28 in the bearing hole 16 in the gear case 10*a*. The toothed rim 25*b* just has teeth on half a circular arc and therefore cannot rotate to an unlimited degree, but only approximately 180 degrees between its extreme positions.

FIG. 4 shows the gear case 10*b* rotated to a position in which the gear wheel 18*b* is in engagement with a gear wheel 29. Rotation of the worm wheel 12*b* causes the gear wheel 18*b* to rotate and thereby drive the gear wheel 29. Rotation of the worm wheel 12*a* may cause the gear case 10*b* to be rotated to another position in which the gear wheel 18*b* engages another gear wheel 30, which may like-wise be rotated by the gear wheel 18*b* by rotation of the worm wheel 12*b*. Thus, by rotation of the worm wheel 12*a* it may be decided whether the gear wheel 18*b* is to be in engagement with the gear wheel 29 or with the gear wheel 30, which can drive its respective mechanism or be two different entrances to a mechanism, e.g. a gear box where they drive their respective gears.

When assembling the two half gear cases 10 to a complete gear case, as mentioned above, the toothed rims 25 of the two half gear cases are placed in contact with each other, and their common contact face forms a symmetry plane and a dividing face for the assembled gear case. The axis of rotation of the worm wheel 12 lies in this plane, and also the gear wheels 18 and 21 are symmetrical about this plane.

Patent Claims:

1. A toy gear box comprising a gear case (10), said gear case (10) accommodating a worm wheel (12) which is rotatable about a first axis of rotation and a gear wheel (18, 21) which has a first number of teeth (20, 23) and is rotatable about a second axis of rotation transversely to the first axis of rotation, said worm wheel (12) and gear wheel (18, 21) being in operative engagement with each other with a first gear ratio, characterized in that the gear wheel (18, 21) is replaceable, and that at least a second gear wheel (21, 18) having a second number of teeth (20, 23) different from the first number may be inserted into the gear box, thereby imparting to the gear box a second gear ratio which is different from the first gear ratio.

2. A toy gear box according to claim 1, characterized in that, for the reception of shafts (19, 22) for two or more gear wheels (19, 21), the gear case (10) has openings (16, 17) correspondingly spaced from the worm wheel (12).

3. A toy gear box according to claim 1, characterized in that the gear case (10) has a toothed rim (25, 26) in firm connection with the gear case (10), and that the gear case (10) can receive such a toothed rim **(25*b*) on another such gear case (10*b*)** as a gear wheel.

4. A toy gear box according to claim 1, characterized in that the gear case (10) comprises two uniform halves which may be assembled and form the gear case (10).

5. A gear case for a toy gear box according to claim 1, capable of accommodating a worm wheel (12) having a first axis of rotation, characterized in that the gear case (10) is capable of accommodating two or more gear wheels (18, 21) with different numbers of teeth (20, 23) and axes of rotation (19, 22) transversely to the axis of rotation (13) of the worm wheel (12) and in operative engagement with the worm wheel (12), thereby imparting correspondingly different gear ratios to the gear box.

6. A gear case according to claim 5, characterized in that, for the reception of shafts (19, 22) for two or more gear wheels (18, 19), it has openings (16, 17) correspondingly spaced from the worm wheel (12).

7. A gear case according to claim 5, characterized in that the gear case (10) has a toothed rim (25, 26) in firm connection with the gear case (10), and that the gear case (10) may receive such a toothed rim (25, 26) on another such gear case as a gear wheel.

8. A gear case according to claim 5, characterized in that it consists of two uniform halves which may be assembled and form the gear case (10).

9. A gear case according to claim 8, characterized in that its two halves have a common, plane dividing face as a symmetry plane for the gear case, that the axis of rotation of the worm wheel lies in this plane, and that each half has an opening (14) for receiving its respective part of a shaft (13) for the worm wheel (12).

10. A gear case for a toy gear box according to claim 1, characterized in that the gear case (10) has a toothed rim (25, 26) in firm connection with the gear case (10), and that the gear case (10) may receive such a toothed rim (25, 26) on another such gear case as a gear wheel.

11. A gear case according to claim 10, characterized in that, for the reception of shafts (19, 22) for two or more gear wheels (18, 21), it has openings (16, 17) correspondingly spaced from the worm wheel.

12. A gear case according to claim 10, characterized in that it consists of two uniform halves which may be assembled and form the gear case (10).

13. A gear case according to claim 12, characterized in that its two halves have a common, plane dividing face as a symmetry plane for the gear case, that the axis of rotation (13) of the worm wheel (12) lies in this plane, and that each half has an opening (14) for receiving its respective part of a shaft for the worm wheel.

* * * * *